US007111880B2

(12) United States Patent
Saitoh

(10) Patent No.: US 7,111,880 B2
(45) Date of Patent: Sep. 26, 2006

(54) OUTSIDE HANDLE ASSEMBLY OF AUTOMOBILE

(75) Inventor: Yutaka Saitoh, Kanagawa (JP)

(73) Assignee: Alpha Corporation, Kanagawa (JP)

( * ) Notice: Subject to any disclaimer, the term of this patent is extended or adjusted under 35 U.S.C. 154(b) by 147 days.

(21) Appl. No.: 10/892,108

(22) Filed: Jul. 16, 2004

(65) Prior Publication Data

US 2005/0012345 A1 Jan. 20, 2005

(30) Foreign Application Priority Data

Jul. 18, 2003 (JP) ..... 2003-277137

(51) Int. Cl.
*E05B 3/00* (2006.01)

(52) U.S. Cl. ..... 292/336.3; 292/DIG. 22

(58) Field of Classification Search ..... 292/336.3, 292/DIG. 22, 247, DIG. 65; 16/412
See application file for complete search history.

(56) References Cited

U.S. PATENT DOCUMENTS 3,719,248 A * 3/1973 Breitschwerdt et al. ..... 180/271
4,382,622 A * 5/1983 Ishikawa ..... 292/216
4,995,654 A * 2/1991 Nishigami et al. ..... 292/216
5,584,516 A * 12/1996 Cetnar ..... 292/336.3
6,070,923 A * 6/2000 Tanimoto et al. ..... 292/336.3
6,880,867 B1 * 4/2005 Schoen et al. ..... 292/216

FOREIGN PATENT DOCUMENTS

JP 3-47085 10/1991

* cited by examiner

*Primary Examiner*—Gary Estremsky
(74) *Attorney, Agent, or Firm*—Arent Fox PLLC

(57) ABSTRACT

An outside handle assembly for an automobile is constructed to have a handle body 3 connected to a handle base 2 secured to an automobile panel 1, and a connecting lever 7 swingably connected to the handle body 3 and driven vertically by an operating force applied to the handle body 3 so that an engaging portion 4 formed toward its lower end may push an unlocking lever 6 in a locking device 5 to release the locking device 5 from its locking state. The engaging portion 4 is formed to be disengageable from the unlocking lever 6 upon swinging of the connecting lever 7 toward the center of the automobile body. The handle base 2 is provided with a panel deformation detector 8 protruding toward the connecting lever 7. The connecting lever 7 being urged toward the panel 1 by urging member 9.

5 Claims, 6 Drawing Sheets

OUTSIDE HANDLE ASSEMBLY OF AUTOMOBILE

BACKGROUND OF THE INVENTION

This invention relates to an outside handle assembly of an automobile.

JP-Y-03-047085 discloses a door so constructed as not to open inadvertently by an impact arising from collision on an automobile body. According to JP-Y-03-047085, the door is provided with a locking mechanism for keeping the door in its closed state and a knob which is operable from the outside of the automobile.

The locking mechanism has a release lever for releasing the locking mechanism by a push-down action, the knob and the release lever are connected by a rod linkage and a protrusion projecting from the door is positioned in the vicinity of the rod linkage. The connection of the rod linkage and the release lever is made by inserting the lower end of the rod linkage in a slit formed in the release lever.

The slit is open toward the inside of the automobile body and upon deformation of the door by collision, the rod linkage is disengaged from the release lever as it is pushed toward the inside of the automobile body by the protrusion and leaves the slit of the release lever, whereafter the door can no longer be opened even if the knob is pressed. A rubber stop is positioned in the opening of the slit so that the swinging, etc. of the rod linkage during the traveling of the automobile, etc. may not cause its disengagement from the release lever.

However, since the protrusion is made to follow the deformation of the outer panel so as to actuate the rod linkage, in JP-Y-03-047085, the following problems are occurred.

That is, according to the example of JP-Y-03-047085, a release operation for the rod linkage takes place upon occurrence of deformation of the panel, irrespective of a position of the collision or the magnitude of the impact. Once the rod linkage is disengaged, the rubber stop restrains its re-engagement with the release lever, and even when their disengagement has resulted from such a degree of deformation as does not require a replacement of the door, its repair, etc., their re-engagement calls for an access to the interior of the door and its maintenance property is, therefore, very low.

It also has the drawback that, since a posture of the rod linkage at a point of its engagement with the release lever depends upon the weight of the rod linkage, a noise of collision is produced at the point of their engagement if the rod linkage swings or vibrates during the traveling of the automobile.

SUMMARY OF THE INVENTION

Therefore, this invention has been made to overcome the drawbacks as stated above, and it is an object of the invention to provide an outside handle assembly of an automobile which is easy to maintain and can effectively prevent the occurrence of any abnormal sound during the traveling of the automobile.

According to this invention, the above object is attained by providing an outside handle assembly having a handle body 3 connected to a handle base 2 fixed to an automobile panel 1, and a connecting lever 7 swingably connected to the handle body 3 and driven vertically by an operating force applied to the handle body 3 so that an engaging portion 4 formed toward its lower end may push an unlocking lever 6 in a locking device 5 to release the locking device 5 from its locking state, the engaging portion 4 being so formed as to be disengageable from the unlocking lever 6 upon swinging of the connecting lever 7 toward the center direction of an automobile body, the handle base 2 being provided with a panel deformation detector 8 protruding toward the connecting lever 7, the connecting lever 7 being urged toward the panel 1 by urging member 9.

The connecting lever 7 is swingably connected to the handle body 3 and is driven vertically (along the height of the automobile) when the handle body 3 is operated in its opening direction. The unlocking lever 6 of the locking device 5 is engaged with the lower end of the connecting lever 7 and is pushed down or pulled up to release the locking device 5 from its locking state when the connecting lever 7 is driven vertically.

The engagement between the unlocking lever 6 and the engaging portion 4 formed in the connecting lever 7 for its engagement with the unlocking lever 7 can be released by the swinging of the connecting lever 7, and even if the connecting lever 7 may be driven downward after their engagement has been released, the unlocking lever 6 does not function. The direction in which their engagement is released is set in the direction of rotation of the connecting lever 7 in which its engaging portion 4 becomes farther from the panel 1, and the connecting lever 7 is urged in its engaging direction by the urging member 9.

As a result, the state of contact between the engaging portion 4 and the unlocking lever is always the state of pressure contact, so that it is reliably possible to prevent any sound of collision occurring from the vibration of the automobile, etc.

According to this invention in which the state of pressure contact between the engaging portion 4 of the connecting lever 7 and the unlocking lever 6 is ensured by the urging member 9, and the direction of its disengagement from the unlocking lever 6 at the point of their pressure contact is set in the direction in which the point of their pressure contact becomes farther from the panel 1, the connecting lever 7 is loaded with an inertial force causing its engaging portion 4 to move toward the panel 1 and a force of reaction from the unlocking lever 6 when an impact force directed toward the center of the automobile body is loaded on the panel 1. As the force of reaction acts in the direction in which the engaging portion 4 moves toward the center of the automobile body, the engagement of the engaging portion 4 is released temporary, but is automatically restored by an urging force to permit a door opening and closing operation by the handle body 3 again.

If, for example, the response characteristics of the urging member 9, the moment of inertia of the handle body 3 or the connecting lever 7 and the sliding resistance about the axis of rotation are set properly by utilizing the reaction, it is possible to adjust the response time for the downward movement of the connecting lever 7 by an inertial force occurring to the handle body 3 in the direction of its door opening operation after an impact force is loaded on the panel 1, and the response time for the disengagement of the connecting lever 7 from the unlocking lever 6 by reaction. As a result, the proper setting of those response characteristics makes it possible to disengage the connecting lever 7 from the unlocking lever 6 before an operating force attributed to an inertial force occurring to the handle body 3 is transmitted to the connecting lever 7, and thereafter return them into the state of engagement.

On the other hand, if the handle assembly has been loaded with an impact force by which it is likely to be damaged, or if the position or posture in which the handle assembly is installed has been changed, the state of engagement is not restored, since the panel deformation detector 8 formed on the handle base prevents the movement of the connecting lever 7 by the urging member 9 in the direction for restoring engagement. As a result, it is certain that the engagement between the connecting lever 7 and unlocking lever 6 is severed to prevent the opening of the door at the time of a collision on a relatively large scale.

According to this invention, it is possible to achieve an improved property of maintenance and an improved safety, since the engagement between the connecting lever 7 and the unlocking lever 6 is severed in an unrestorable way only in the event of a collision changing the position or posture in which the handle assembly is installed.

It is also possible to prevent any abnormal sound from occurring during the traveling of the automobile, etc., since the engaging portion 4 of the connecting lever 7 is maintained in the state of pressure contact by the urging member 9.

DESCRIPTION OF THE PREFERRED EMBODIMENT

Figure 1:
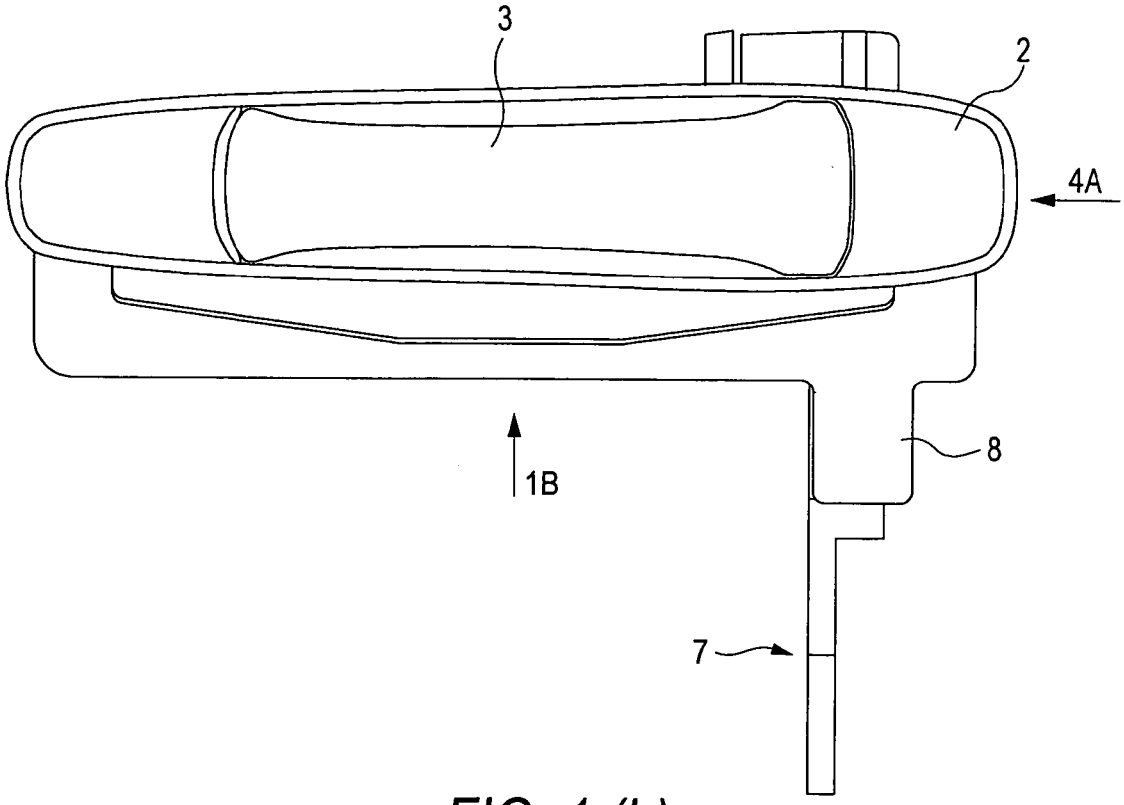
FIG. 1(*a*) is a front view of the invention, and FIG. 1(*b*) a view taken in the direction of an arrow 1B in FIG. 1(*a*).
Figure 1:
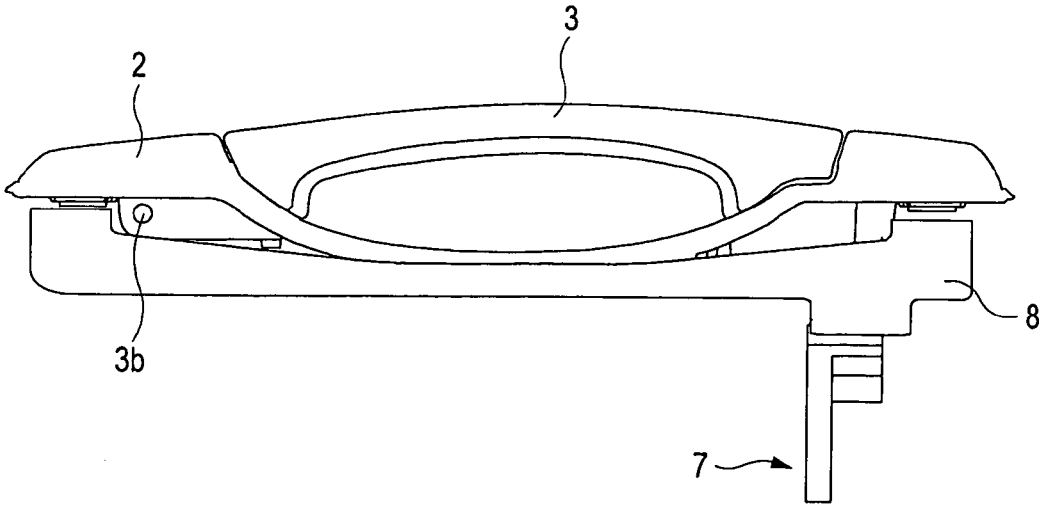
Figure 2:
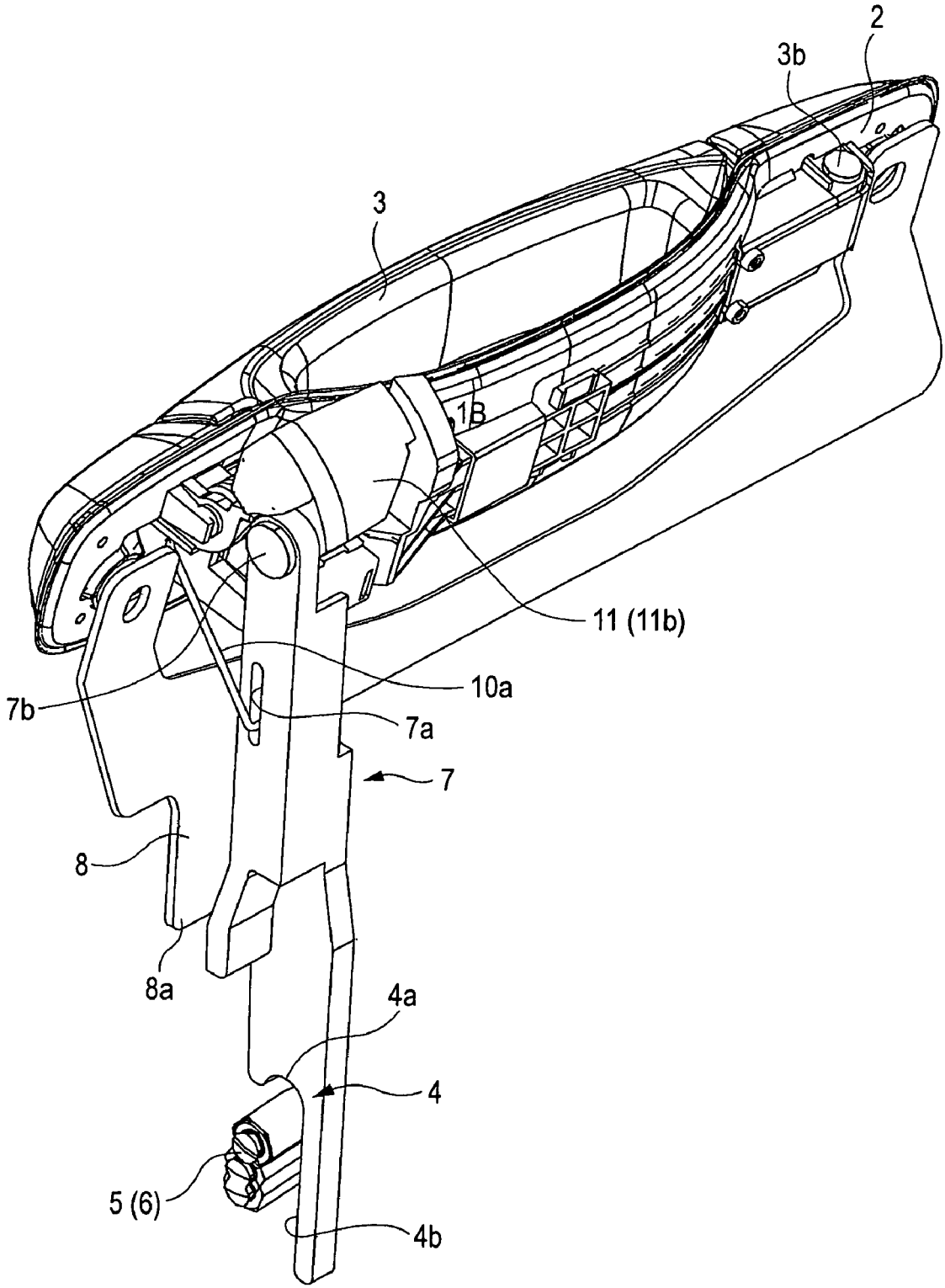
FIG. 2 is a perspective view taken from the back side of FIG. 1(*a*).

FIGS. 1 to 4 show a first embodiment of this invention as constructed for opening and closing an automobile side door. A handle assembly has a handle base 2 fixed to an automobile outer panel 1 and a handle body 3 swingably connected to the handle base 2.

The handle body 3 is swingable between its initial position in which it lies substantially alongside the outer panel 1, and its opening position reached when it is pulled away from the outer panel 1, and a relay lever 11 is connected to the handle base 2 for moving up and down a connecting lever 7 as will be described later, with the operation of the handle body 3 toward its opening position.

Structural examples of the handle body 3, handle base 2 and relay lever 11 will now be described, but various modifications will be possible if the handle body 3, handle base 2 and relay lever 11 have the relation as described above, and the disclosure of this specification should not be limited to the arbitrary combination of shape, positional relation and state of installation as shown below. For example, the following description of the relay lever 11 serving as a counterweight, too, is not intended to deny any statement about "a relay lever 11 not serving as a counterweight".

Figure 3:
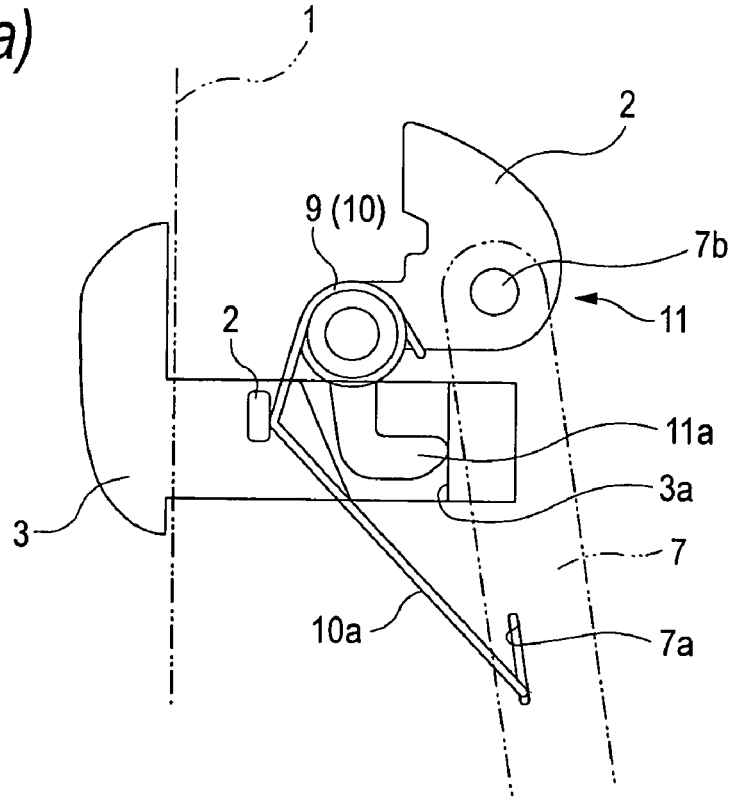
FIGS. 3(*a*) and 3(*b*) are views showing the operation of a handle body, wherein FIG. 3(*a*) is a view showing its initial state, and FIG. 3(*b*) is a view showing the handle body as rotated to its opening position.
Figure 3:
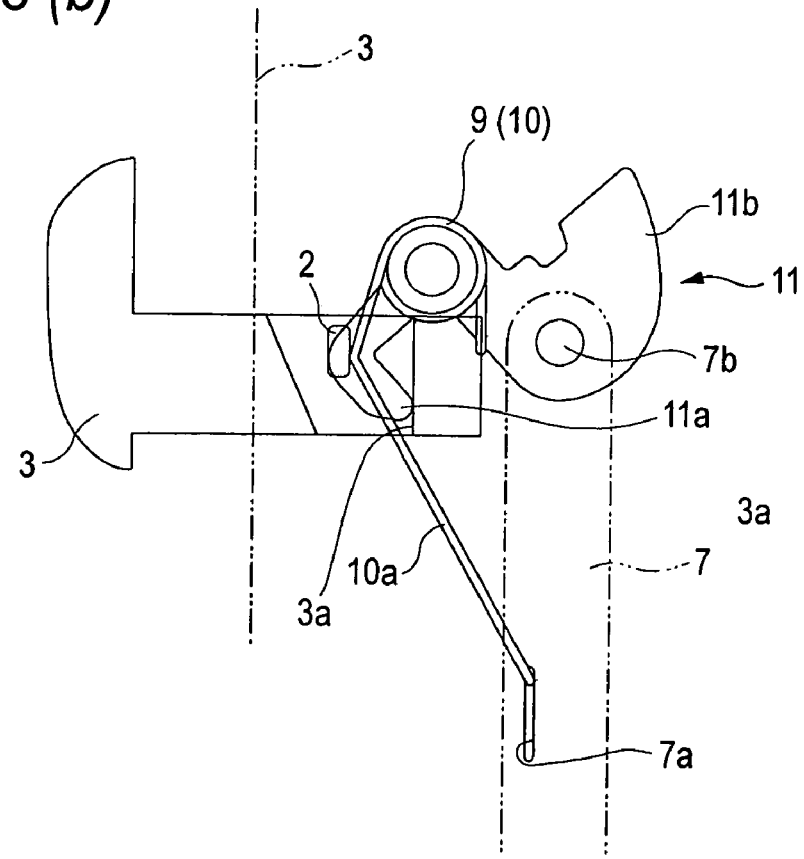

The handle body 3 has a horizontally long shape and one end thereof is swingably connected to the handle base 2, while a lever operating portion 3*a* in the form of a hole is formed at the other end thereof (see FIG. 3). The handle assembly is usually mounted to the outer panel 1 in its posture in which an axis 3*b* of rotation extends along the height of the automobile, or in which the handle body 3 is substantially horizontally rotatable (a rotational axis of the swing motion of the handle body extends along the height direction of the automobile). In its mounted state, the rotation of the handle body 3 toward its opening position causes the lever operating portion 3*a* to move from its initial position as shown in FIG. 3(*a*) to its opening position closer to the outside of the automobile body as shown in FIG. 3(*b*).

The relay lever 11 having a handle operating portion 11*a* engaging the lever operating portion 3*a* is rotatably connected to the handle base 2. The relay lever 11 has its handle operating portion 11*a* urged away from the outer panel 1 by a torsion spring 10 wound about its axis of rotation, and the handle body 3 is also urged toward its initial position and held there by the urging force acting up on the handle operating portion 11*a*.

The relay lever 11 is provided with a weight portion 11*b*. The weight portion 11*b* is provided for adjusting the weight of the relay lever 11 and its center of gravity to have the relay lever 11 function as a counterweight for producing an inertial force canceling a force occurring to the handle body 3 to urge it toward its opening position when an impact force has been applied to the outer panel 1.

The connecting lever 7 has one end connected to the relay lever 11 swingably about its center 7*b* of swinging. The connecting lever 7 has at its lower end an engaging portion 4 engaging the unlocking lever 6 of a locking device 5 positioned within the door body.

The engaging portion 4 has a pressing portion 4*a* engaging the upper surface of the unlocking lever 6 so as to be capable of pressing down the unlocking lever 6, and a pressure contact portion 4*b* contacting the unlocking lever 6 on its opposite side from the outer panel 1 throughout the whole stroke of vertical movement of the connecting lever 7 to ensure the contact of the connecting lever 7 with the unlocking lever 6 by its swinging force as will be described later. The engaging portion 4 is open toward the outer panel 1 so that its movement relative to the unlocking lever 6 toward the outer panel 1 may be allowed.

Therefore, when the handle body 3 is moved in its opening direction in this embodiment, the connecting lever 7 is driven downward and the unlocking lever 6 is pressed down by the engaging portion 4. The pressing down of the unlocking lever 6 causes the locking device 5 to release the door body from its locked state and allows the door body to open.

Although the unlocking lever 6 has been shown as being driven downward by the opening operation of the handle body 3, it is alternatively possible to construct it so that it may be driven upward and operate the locking device 5 adapted to sever the locked state when the unlocking lever 6 has been pulled up, and in this case, the pressing portion 4*a* is so constructed as to engage the lower surface of the connecting lever 7.

The connecting lever 7 constructed as described has its engaging portion 4 urged by the urging member 9 in the direction in which it approaches the outer panel 1. In the present mode of embodiment, the torsion spring 10 urging the relay lever 11 toward its initial position is used as the urging member 9. For the use of the torsion spring 10 as the urging member 9, a spring engaging hole 7*a* in the form of a slit is formed in the connecting lever 7 along its length and one leg 10*a* of the torsion spring 10 is engaged therein.

In this embodiment, therefore, the connecting lever 7 is given torque for rotation about the center 7*b* of its swinging with the relay lever 11 in the direction in which its engaging portion 4 approaches the outer panel 1, and as a result, its pressing portion 4*a* makes pressure contact with the unlocking lever 6.

Even if the connecting lever 7 may, then, be loaded by an impact, etc. with torque for rotation in the direction of disengagement, resulting in the temporary disengagement between the engaging portion 4 and the unlocking lever 6 and thereby the inability to transmit an operating force from the handle body 3 to the locking device 5, the state of their engagement is restored by the action of the urging member 9.

The handle base 2 is provided with a panel deformation detector 8 protruding toward the connecting lever 7 in order to ensure that the transmission of an operating force from the handle body 3 to the locking device 5 be broken at the time of application of such an impact as will cause the deformation of the handle assembly, or a change in the posture or position in which the handle assembly is installed.

The panel deformation detector 8 is formed from, for example, a metallic sheet material and is fixed to the handle base 2 on that side of the outer panel 1 which faces the interior of the automobile. The panel deformation detector 8 is appropriately spaced apart from the outer panel 1, extends downward along the outer panel 1 and has an interfering portion 8*a* formed at an appropriate position (at its lower end in the case shown in the drawing). In the event that the swinging posture of the connecting lever 7 is not determined when the pressing portion 4*a* engages the unlocking lever 6, the connecting lever 7 abuts on the interfering portion 8*a* and the interfering portion 8*a* determines the initial position of the connecting lever 7.

Figure 4:
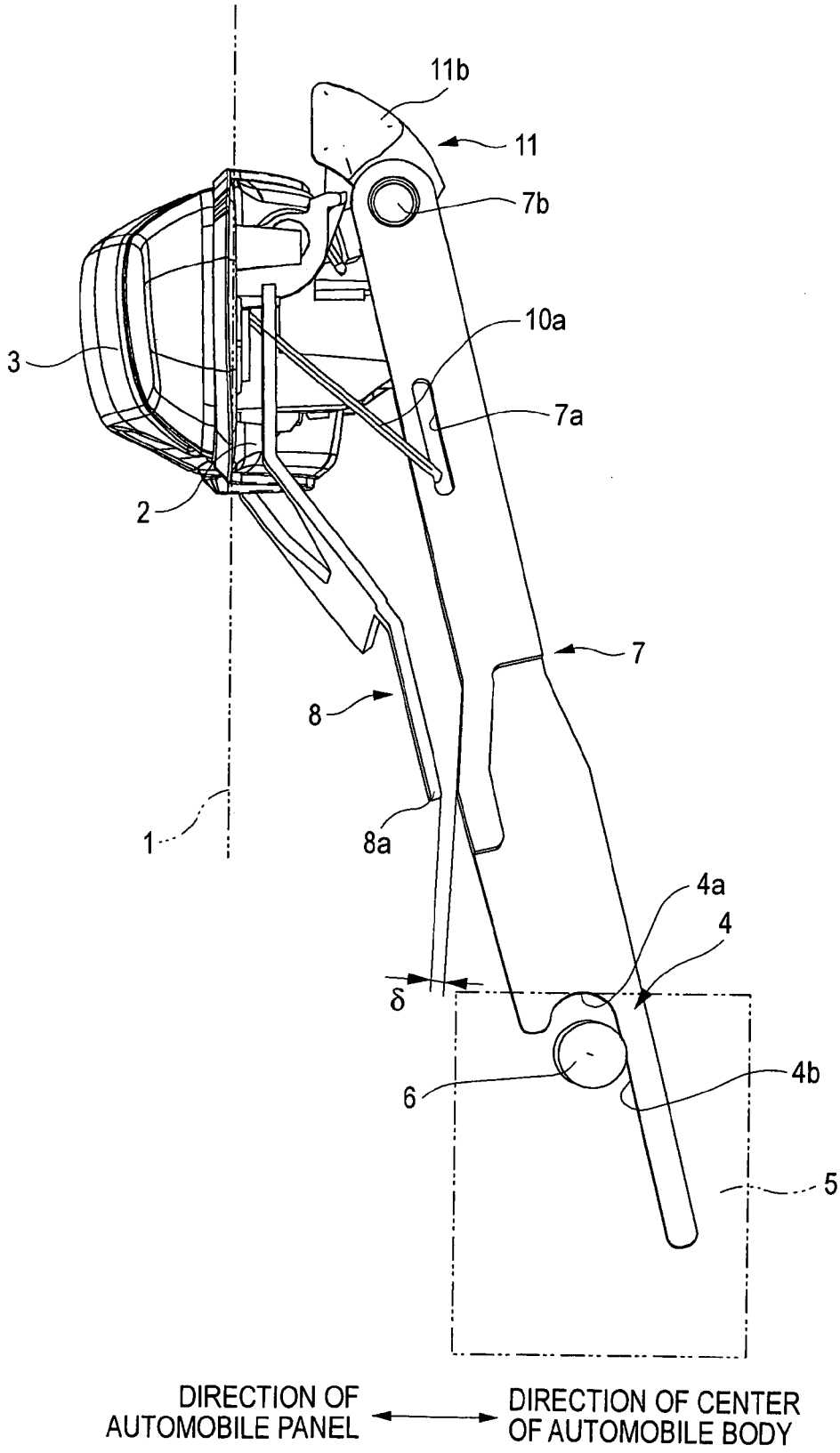
FIG. 4 is a view taken in the direction of an arrow 4A in FIG. 1(*a*) and showing the relation between a connecting lever and a locking device.
Figure 5:
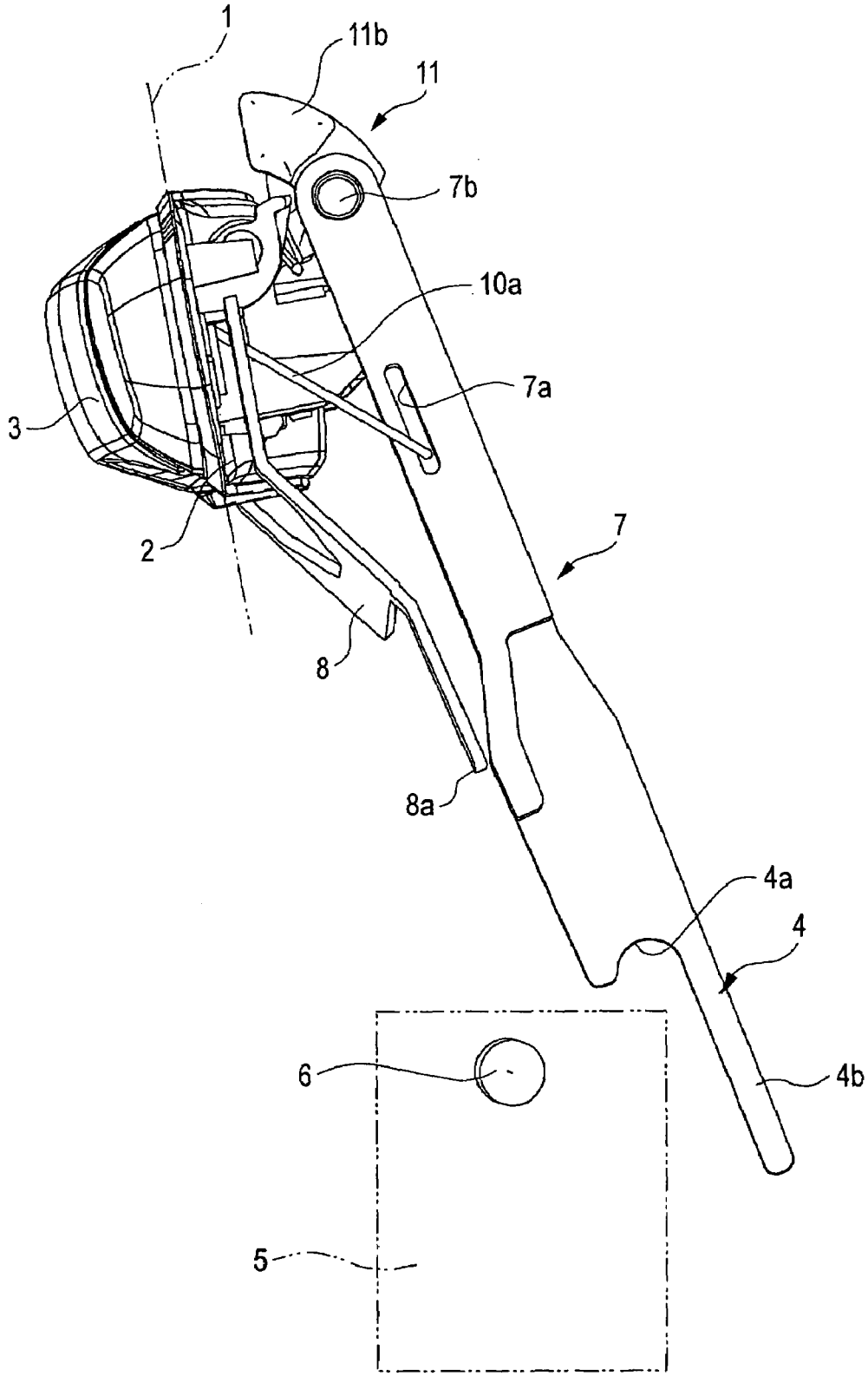
FIG. 5 is a view taken in the direction of the arrow 4A in FIG. 1(*a*) and showing the state of disengagement of an engaging portion.

In this embodiment, therefore, if the outer panel 1 is loaded with an impact force, etc. and causes the handle assembly to move from its normal state shown in FIG. 4 toward the interior of the automobile body, or incline, as shown in FIG. 5, the connecting lever 7 is first caused by the action of the urging member 9 to attempt to swing clockwise in FIG. 4 to absorb the amount of movement of the handle assembly and secure the state of engagement at its engaging portion 4. Then, if the handle assembly further moves (the handle assembly is further deformed) beyond a predetermined threshold value, the connecting lever 7 eventually abuts on the interfering portion 8*a* of the panel deformation detector 8 and thereafter follows the movement of the panel deformation detector 8, or the handle assembly and swings in the opposite direction (anti-clockwise). Its direction of swinging on that occasion coincides with the direction in which its engaging portion 4 severs its engagement with the unlocking lever 6, and if the movement of the handle assembly further continues, the engagement between the engaging portion 4 and the unlocking lever 6 is released (the engaging portion 4 and the unlocking lever 6 is disengaged) and an operating force to the handle body 3 thereafter ceases not to be transmitted to the locking device 5.

Thus, if a gap (δ) between the interfering portion 8*a* and the connecting lever 7 is set properly when the handle assembly is secured to the outer panel 1, it is possible to cut off the operating force transmission route from the handle body 3 in an unrestorable way only when a positional change in the handle assembly over a specific value has, for example, occurred.

Although FIG. 5 shows the handle assembly which has inclined, a similar mechanism causes the disengagement of the engaging portion 4 when the handle assembly has moved toward the center of the automobile body in parallel thereto, too.

Figure 6:
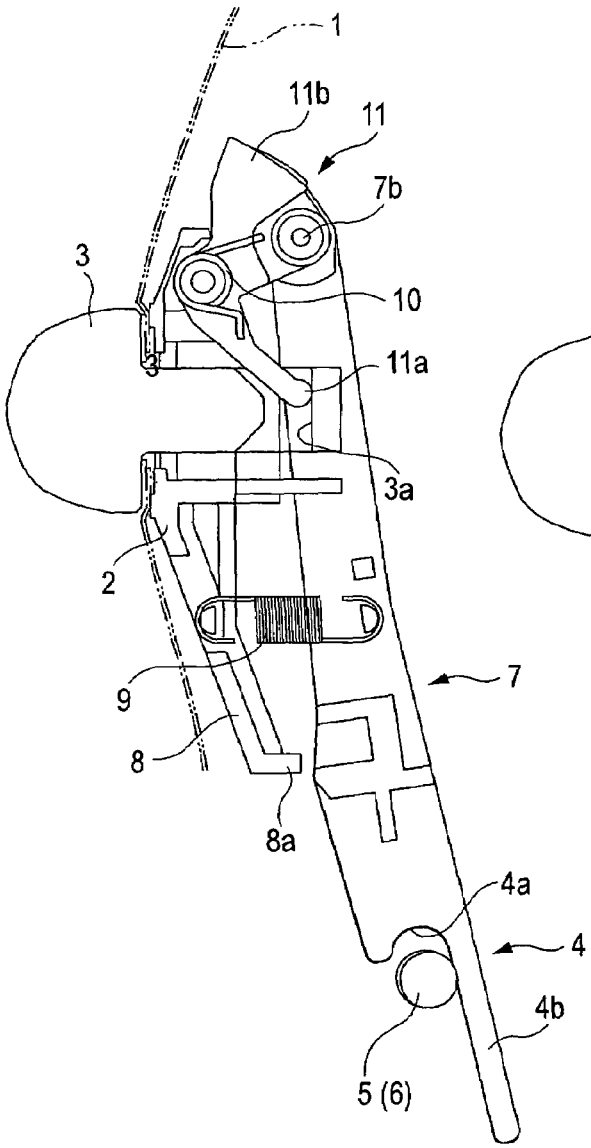
FIGS. 6(*a*) and 6(*b*) are views showing a second embodiment of this invention, wherein FIG. 6(*a*) is a view showing its initial state, and FIG. 6(*b*) is a view showing the handle body as rotated to its opening position.
Figure 6:
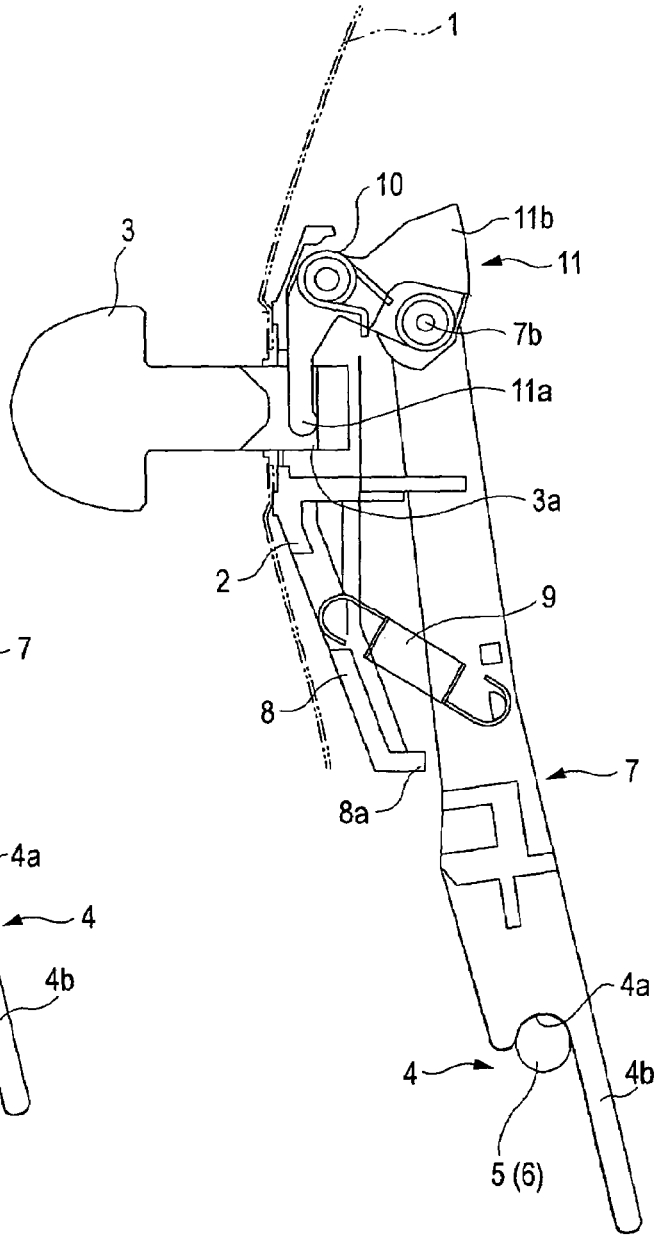

FIGS. 6(*a*) and 6(*b*) shows a second embodiment. The description of this embodiment omits the description of substantially the same structural elements as those in Embodiment 1 described above, as the same reference numerals are given to them in the drawings.

According to this embodiment, urging member 9 is set as an independent part separate from a torsion spring 10 for imparting a rotational force to a relay lever 11. A panel deformation detector 8 is formed integrally with a handle base 2 secured on the rear side of an outer panel 1.

What is claimed is:

1. An outside handle assembly for an automobile comprising:

a handle base fixed to an automobile panel;

a handle body connected to the handle base;

a connecting lever swingably connected to the handle body, and vertically driven by an operating force applied to the handle body;

an urging member having one end connected to the handle base and the other end engaged to the connecting lever, wherein the connecting lever is urged toward the automobile panel by the urging member;

a locking device having an unlocking lever;

an engaging portion formed on a lower end of the connecting lever, wherein the engaging portion is arranged to push the unlocking lever to release the locking device from a locking state when the connecting lever is vertically driven, and the engaging portion is formed to be disengaged from the unlocking lever when the connecting lever is swung toward a center of the automobile body; and a panel deformation detector provided on the handle base and configured to protrude toward the connecting lever.

2. The outside handle assembly for an automobile according to claim 1, further comprising: a torsion spring for urging the handle body toward an initial position of the handle body, wherein one leg of the torsion spring is engaged with the connecting lever and serving as the urging member.

3. The outside handle assembly for an automobile according to claim 1, wherein the handle body has a horizontally long shape and one end thereof is swingably connected to the handle base, wherein a rotational axis of a swing motion of the handle body extends along the height of the automobile.

4. The outside handle assembly for an automobile according to claim 1, wherein the engaging portion includes:

a pressing portion for engaging the upper surface of the unlocking lever to press down the unlocking lever; and a pressure contact portion for contacting the unlocking lever on its opposite side from the automobile panel throughout the whole stroke of vertical movement of the connecting lever, and wherein the engaging portion is opened toward the automobile panel so that the engaging portion is movable relative to the unlocking lever away from the outer panel.

5. The outside handle assembly for an automobile according to claim 1, wherein the panel deformation detector includes an interfering portion, and when the handle assembly is deformed beyond a predetermined value, the connecting lever directly engages the interfering portion to disengage the engaging portion and the unlocking lever from each other.

* * * * *